US011832776B2

(12) United States Patent
Ren

(10) Patent No.: US 11,832,776 B2
(45) Date of Patent: Dec. 5, 2023

(54) MOP SELF-LIFTING CLEANING TOOL

(71) Applicant: HEBEI JIESHIBAO DAILY PLASTIC PRODUCTS CO., LTD., Heibei (CN)

(72) Inventor: Yongwang Ren, Hebei (CN)

(73) Assignee: HEBEI JIESHIBAO DAILY PLASTIC PRODUCTS CO., LTD., Hebei (CN)

( * ) Notice: Subject to any disclaimer, the term of this patent is extended or adjusted under 35 U.S.C. 154(b) by 0 days.

(21) Appl. No.: 17/622,447

(22) PCT Filed: Nov. 17, 2020

(86) PCT No.: PCT/CN2020/129270
§ 371 (c)(1),
(2) Date: Dec. 23, 2021

(87) PCT Pub. No.: WO2022/007292
PCT Pub. Date: Jan. 13, 2022

(65) Prior Publication Data

US 2023/0124882 A1 Apr. 20, 2023

(30) Foreign Application Priority Data

Jul. 8, 2020 (CN) ..... 202010652864.7

(51) Int. Cl.
*A47L 13/60* (2006.01)
*A47L 13/258* (2006.01)
*A47L 13/58* (2006.01)

(52) U.S. Cl.
CPC ..... *A47L 13/60* (2013.01); *A47L 13/258* (2013.01); *A47L 13/58* (2013.01)

(58) Field of Classification Search
CPC ..... A47L 13/258; A47L 13/58; A47L 13/59; A47L 13/60
See application file for complete search history.

(56) References Cited

U.S. PATENT DOCUMENTS

2012/0192373 A1 8/2012 Ching-Ming
2021/0259505 A1 8/2021 Zhu et al.

FOREIGN PATENT DOCUMENTS

CN 111214190 A 6/2018
CN 108852212 A 11/2018
(Continued)

OTHER PUBLICATIONS

International Search Report dated Mar. 31, 2021 for corresponding International Application No. PCT/CN2020/129270.

*Primary Examiner* — Randall E Chin
(74) *Attorney, Agent, or Firm* — Dentons Cohen & Grigsby P.C.

(57) ABSTRACT

A mop self-lifting cleaning tool includes a mop and a mop bucket. The mop head of the mop includes a fixed plate and a lifting plate. The fixed plate is connected to the mop rod. The lifting plate is connected to the fixed plate. A gap is provided between the lifting plate and the fixed plate, where the gap is increasingly smaller from the center of the lifting plate to the periphery of the lifting plate. A drive member is located in the gap. When the drive member is located at an end with a larger space of the gap, the lifting plate is located at a low position; and when the mop head rotates, the drive member is configured to move toward the periphery under an action of a centrifugal force and drive the gap to increase so as to elevate the lifting plate to a high position.

20 Claims, 16 Drawing Sheets

(56) References Cited

FOREIGN PATENT DOCUMENTS

| | | | | |
|---|---|---|---|---|
| CN | 109693757 | A | | 4/2019 |
| CN | 209074479 | U | | 7/2019 |
| CN | 209153481 | U | | 7/2019 |
| CN | 209688104 | U | | 11/2019 |
| CN | 111657802 | A | | 9/2020 |
| CN | 212521693 | U | | 2/2021 |
| CN | 114451843 | A | * | 5/2022 |

* cited by examiner

MOP SELF-LIFTING CLEANING TOOL

CROSS-REFERENCE TO RELATED APPLICATIONS

This is a national stage application filed under 37 U.S.C. 371 based on International Patent Application No. PCT/CN2020/129270, filed Nov. 17, 2020, which claims priority to Chinese Patent Application No. 202010652864.7 filed Jul. 8, 2020, the disclosures of which are incorporated herein by reference in their entireties.

TECHNICAL FIELD

The present disclosure relates to the field of cleaning products and, in particular, to a mop self-lifting cleaning tool.

BACKGROUND

Among the existing kit tools of mop and mop bucket, there is a type of mop bucket capable of being lifted and lowered coaxially to achieve cleaning and dewatering. The cleaning and dewatering are completed by lifting and lowering the mop, for example, in the Chinese utility model Patent No. ZL201821379338.2, a self-lifting cleaning tool of a cleaning mop and a cleaning bucket separating clean water and dirty water is disclosed. The cleaning bucket is provided with a lifting device, which achieves the switch between a high position and a low position by manually pulling the mop. For another example, in the Chinese utility model Patent No. ZL201820024081.2, a mop self-lifting cleaning tool is disclosed, which also achieves the switch between a high position and a low position by manually pulling the lifting device.

Such type of mop bucket switches between the cleaning state and the dewatering state by changing the high and low positions of the mop head. During the switch between states, it is necessary to stop the mop head from rotating and then pull the mop upward, which is relatively cumbersome.

SUMMARY

Embodiments of the present disclosure provide a cleaning tool.

A mop self-lifting cleaning tool includes a mop and a mop bucket. The mop includes a mop head and a mop rod, and a support column is located in the mop bucket and configured to support working of the mop, and the mop column supports the mop head for cleaning and/or dewatering.

The mop head includes a fixed plate and a lifting plate, the fixed plate is connected to the mop rod and is rotatable, and the lifting plate is configured to move up and down relative to the fixed plate and is rotatable along with the fixed plate.

A gap is provided between the lifting plate and the fixed plate, where the gap is increasingly smaller from the center of the lifting plate to the periphery of the lifting plate; a drive member is located in the gap; when the drive member is located at an end with a larger space of the gap, the lifting plate is located at a low position; and when the mop head rotates, the drive member is configured to move toward the periphery under an action of a centrifugal force and drive the gap to increase so as to elevate the lifting plate to a high position.

Furthermore, a guide groove is located within the gap and configured to guide the movement direction of the drive member, the guide groove is opened at one of the lifting plate or the fixed plate, and the guide groove is oblique to form a structure in which the gap is increasingly smaller from the center of the lifting plate to the periphery of the lifting plate.

Furthermore, the drive member is spherical or block-shaped, and the drive member is provided with an elastic drive member for driving the mop to move toward the end with the larger space of the gap.

Furthermore, an elastic member is provided between the fixed plate and the lifting plate, and the elastic member drives the gap to be small to make the lifting plate at the low position.

Furthermore, the mop rod is a hand-pressed rotary mop rod, the fixed plate is configured to be driven to rotate through the hand-pressed rotary mop rod; or the mop head is configured to be driven to rotate through a motor Furthermore, the lifting plate has a cavity, the fixed plate is located within the cavity, and the fixed plate has a boss protruding out of the cavity, the lifting plate has a through hole for the boss to penetrate through, and the mop rod is movably connected to the boss.

Furthermore, the through hole has an axially extended hole wall, the hole wall abuts a sidewall of the boss, and both the hole wall and the sidewall are provided with a through opening, the drive member is provided with a positioning column which is insertable into the through opening, and when the drive member is located at the end with the larger space of the gap, the positioning column is configured to be inserted into both through openings to lock the lifting plate.

Furthermore, the mop bucket is provided with a clean water area and a working area above the clean water area, a pump is located within the clean water area and configured to pump clean water to the working area, a drive part for driving the pump to work penetrates from the clean water area to the working area, and an upper end of the drive part is the support column.

The mop is supportable by the drive part to be capable of working rotatably, and an engaging part is provided between the lifting plate and the drive part so as to stop the lifting plate and the drive part from rotating in a circumferential direction, when the lifting plate is located at the low position, the engaging part is configured to engage to drive the pump to work, and the pump is configured to pump out the clean water and spray the clean water on the mop; and when the lifting plate is located at the high position, the engaging part is configured to disengage to cause the pump to stop working and cause the mop to continue to rotate for dewatering.

Furthermore, the mop bucket is further provided with a dirty water area which does not communicate with the clean water area and communicates with the working area, and dirty water generated by the working of the mop in the working area is capable of flowing into the dirty water area.

Furthermore, the pump includes a pump housing and an impeller, the impeller is sleeved on a spindle fixed to the mop bucket and is rotatable, the impeller has a drive shaft arranged coaxially with the impeller, the drive shaft penetrates through the clean water area and forms the drive part, and the mop head has a positioning hole available for the drive shaft to insert.

Furthermore, the pump includes a piston pump, and the piston pump is connected to the drive part and is driven by the drive part.

Furthermore, a piston rod of the piston pump is hinged to an eccentric wheel through a connecting rod, and the eccentric wheel is connected to the drive part through a gear mechanism.

Furthermore, the engaging part includes a ridge arranged on the periphery of the drive part and a groove arranged on an inner side wall of the positioning hole, and the ridge and the groove are capable of being engaged with each other to limit a circumferential rotation of the drive shaft and the lifting plate.

Furthermore, the mop bucket includes a first bucket body and a second bucket body which are stacked in the upper and lower direction, the first bucket body under the second bucket body is the clean water area, the second bucket body on the first bucket body is the working area, and the periphery of the second bucket body extends downward to form a receiving chamber, and the receiving chamber is the dirty water area.

Furthermore, the mop bucket includes a bucket body, the bucket body has a partition plate and a cover plate. The partition plate separates an inner chamber of the bucket body into the clean water area and the dirty water area. The cover plate is arranged above the clean water area. The working area is above the cover plate.

Furthermore, a cleaning member for cleaning the mop is arranged in the mop bucket, and when cleaning the mop at a low position, the cleaning member is in contact with a wipe of the mop for cleaning the wipe.

Furthermore, the cleaning member comprises a cleaning blade, a cleaning brush, or a roller rotatable along the axis of the roller.

Figure 1:
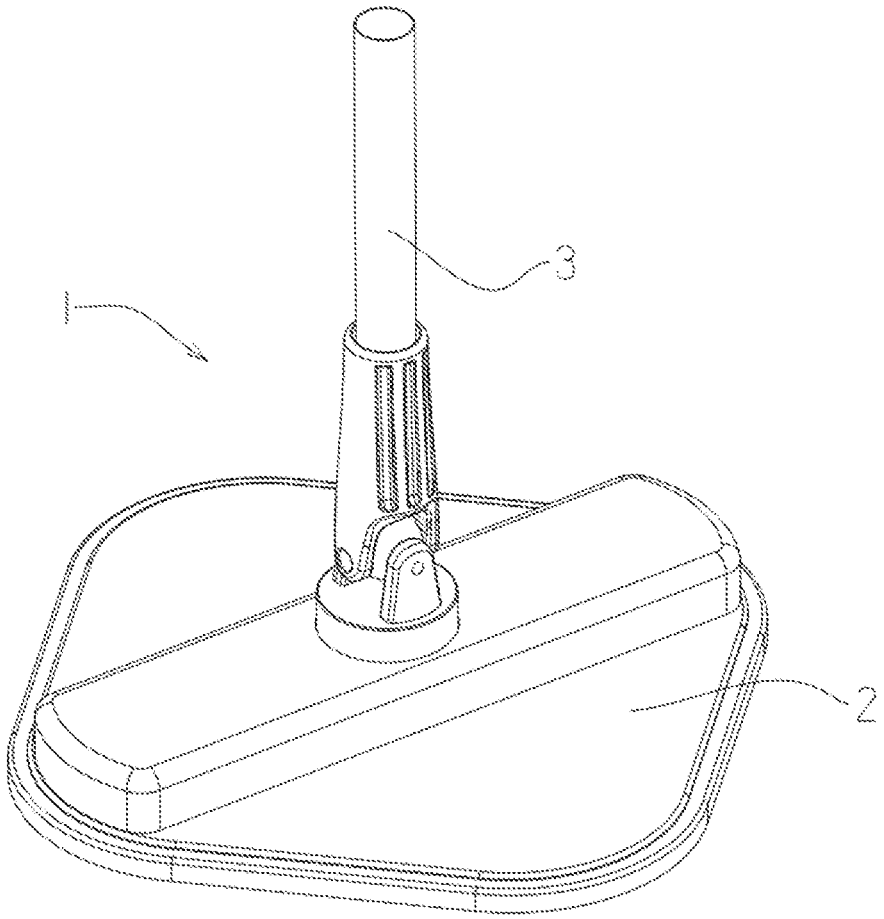
FIG. 1 is a view illustrating the overall structure of a rotary mop of embodiment one.

Reference numerals are listed as follows:

mop 1;

mop head 2, fixed plate 21, boss 211, lifting plate 22, cavity 221, hole wall 222, through hole 224, through opening 223, elastic member 23, and panel 24;

mop rod 3;

gap 4, and guide groove 41;

drive member 5, elastic drive member 51, positioning column 52, rib 53, inclined surface 54, and balancing weight 55;

mop bucket 6, clean water area 61, water injection port 611, working area 62, dirty water area 63, first bucket body 64, second bucket body 65, receiving chamber 651, support column 66, bucket body 67, partition plate 671, cleaning brush 68, swash holder 681, water spray port 682, cover plate 69;

pump 7, drive part 71, rib 721, groove 722, impeller 73, drive shaft 731, positioning hole 732, blind hole 7321, through hole 7322, spindle 74, plane bearing 75, water outlet 76, piston pump 77, piston rod 771, connecting rod 772, eccentric wheel 773, pump body 774, water inlet 7741, water outlet 7742, driving gear 775, driven gear 776, and pump housing 78; and roller 8, tine 81.

DETAILED DESCRIPTION

Embodiments of the present disclosure are described below in detail in conjunction with the drawings, so that advantages and features of the present disclosure can be more easily understood by those skilled in the art, thereby more clearly defining the scope of the present disclosure.

Embodiment One

A rotary mop is as shown in FIG. 1. The mop 1 includes a mop head 2 and a mop rod 3, and the mop head 2 is rotatable to achieve cleaning and/or dewatering, and the rotation of the mop head 2 is driven by a hand-pressed mop rod 3 or a motor.

Figure 2:
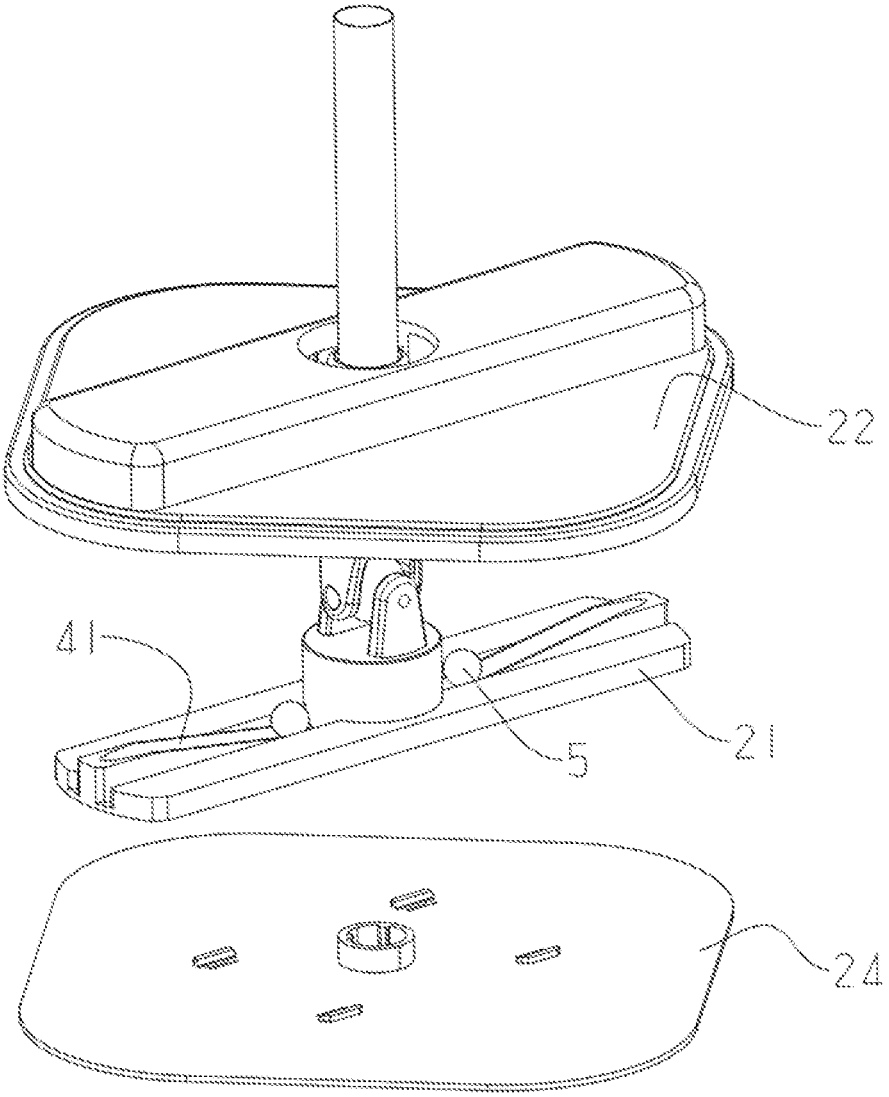
FIG. 2 is an exploded view of a rotary mop of embodiment one.
Figure 3:
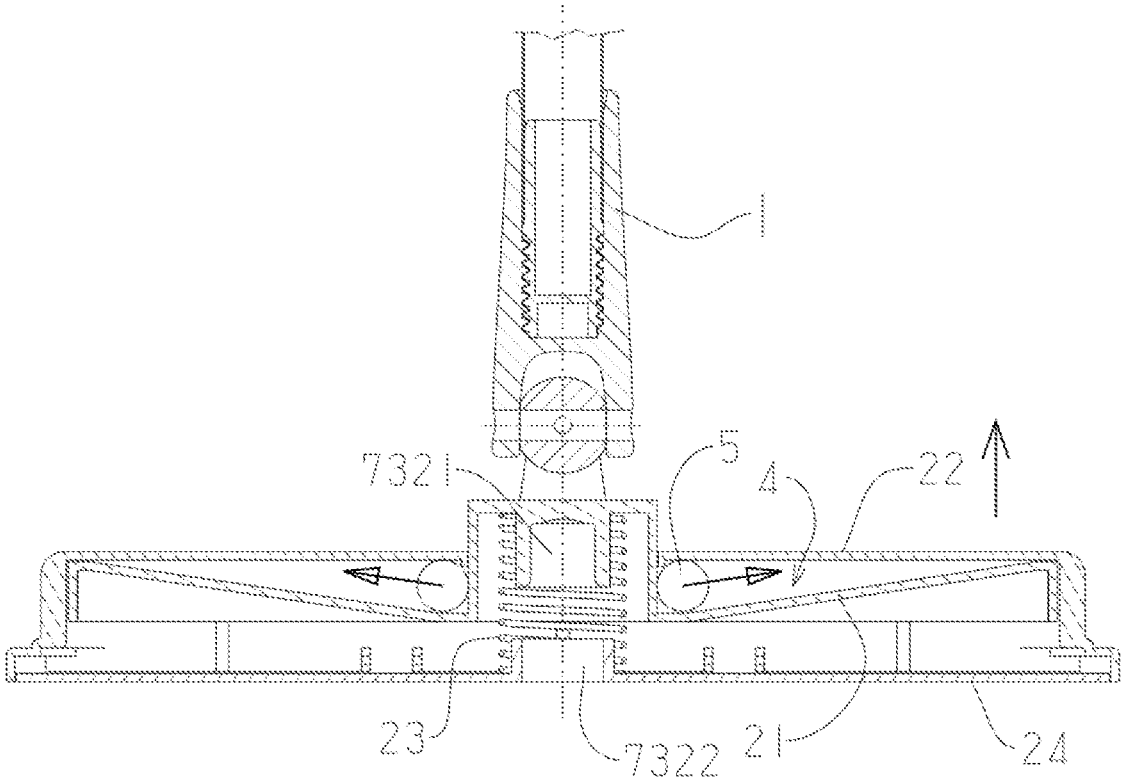
FIG. 3 is a sectional view of a rotary mop of embodiment one (in which a lifting plate is at a low position)
Figure 4:
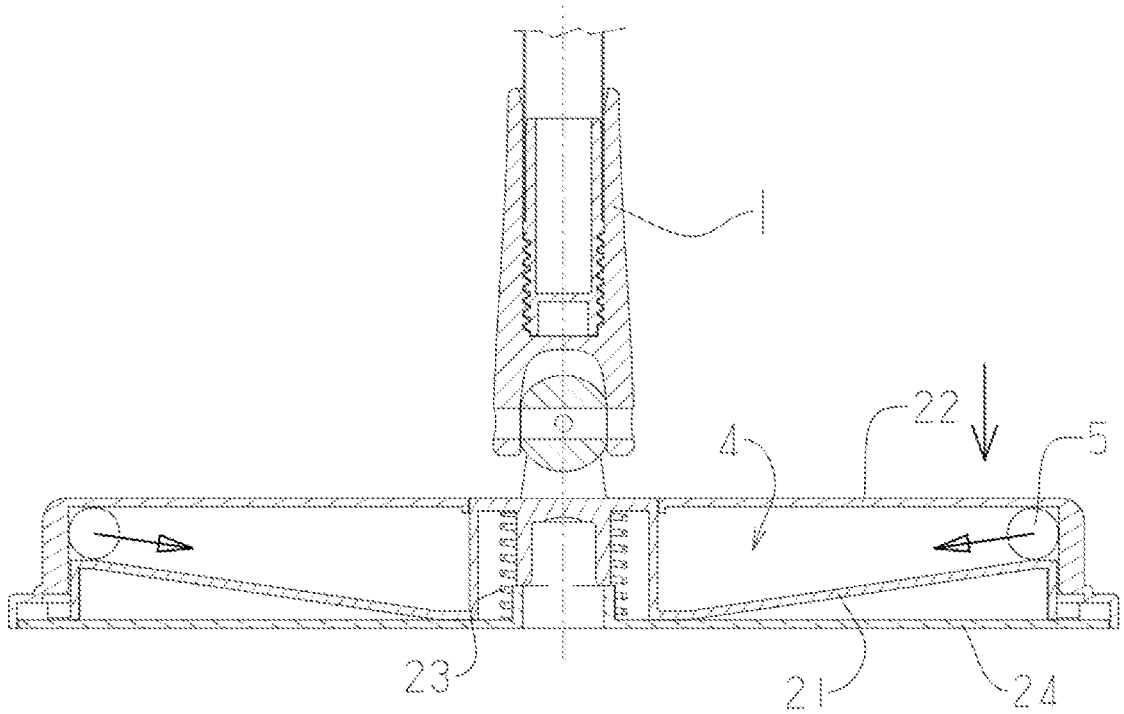
FIG. 4 is a sectional view of a rotary mop of embodiment one (in which a lifting plate is at a high position)

As shown in FIGS. 2 to 4, the mop head 2 includes a fixed plate 21 and a lifting plate 22, the fixed plate 21 is connected to the mop rod 3 and is rotatable, the lifting plate 22 is connected to the fixed plate 21, the lifting plate 22 is configured to move up and down relative to the fixed plate 21 and is rotatable along with the fixed plate 21; and a wipe is fixedly connected to the lifting plate 22. It is to be noted that up-and-down movement of the lifting plate 22 is relative to a state in which the mop head 2 is located below.

A gap 4 is provided between the lifting plate 22 and the fixed plate 21, where the gap 4 is increasingly smaller from the center of the lifting plate 22 to the periphery of the lifting plate 22; a drive member 5 is located in the gap 4; when the drive member 5 is located at an end with a larger space of the gap 4, the lifting plate 22 is located at a low position; and when the mop head 2 rotates, the drive member 5 is configured to move toward the periphery under an action of a centrifugal force and drive the gap 4 to increase so as to elevate the lifting plate 22 to a high position, thereby achieving the automatic lifting of the lifting plate 22 provided with the wipe, so that operations at high and low positions can be completed without the manual lifting action.

When implemented, it is well understood that the drive member 5 is capable of opening the gap 4 at a certain rotational speed by adjusting a weight of the drive member 5, and a specific weight of the drive member 5 is not easy to be quantified here because the weight also needs to be tested and adjusted according to a weight of the lifting plate 22 and an accuracy (a sliding smoothness) that the product can actually achieve.

A guide groove 41 is located within the gap 4 and configured to guide the movement direction of the drive member 5, the guide groove 41 is opened at one of the lifting plate 22 or the fixed plate 21, and the guide groove 41 is oblique to form a structure in which the gap 4 is increasingly smaller from the center of the lifting plate 22 to the periphery of the lifting plate 22.

In this embodiment, as shown in FIG. 2, the guide groove 41 is opened at the fixed plate 21, and the guide groove 41 guides the movement direction of the drive member 5, so that the drive member 5 can move along an optimal path to complete the action of opening the lifting plate 22. Preferably, at least two guide grooves 41 are provided, and are evenly distributed according to a rotation axis of the mop head 2.

In this embodiment, two guide grooves 41 are provided (i.e., two drive members 5 are provided), and the configuration of at least two guide grooves 41 can achieve the balance of the mop head 2 when rotating, and after a sample test, two guide grooves 41 (the drive member) can well complete the action of opening the lifting plate 22 and have no influence on the balance of the mop head 2 and the rotation smoothness when the mop head 2 rotates.

Preferably, the drive member 5 is a sphere, and the sphere structure can reduce the friction when moving, so that the drive member 5 can move smoothly.

In this embodiment, the sphere is made of metal, the metal sphere has a certain weight, and a centrifugal force of the rotation can easily move the sphere toward the periphery to open the gap 4.

As shown in FIGS. 3 and 4, an elastic member 23 is provided between the fixed plate 21 and the lifting plate 22, and the elastic member 23 drives the gap 4 to be small to make the lifting plate 22 at the low position. That is, in a normal state, the lifting plate 22 is located at the low position, and the elastic member 23 may also assist in resetting the lifting plate 22 after the lifting plate 22 is located at the high position. In this embodiment, the elastic member 23 is a helical spring.

As for the mop in this embodiment, the rotation of the mop head 2 may be achieved by a hand-pressed rotary mop rod 3 or the motor, both of which belong to the existing art, which will not be repeated.

Figure 5:
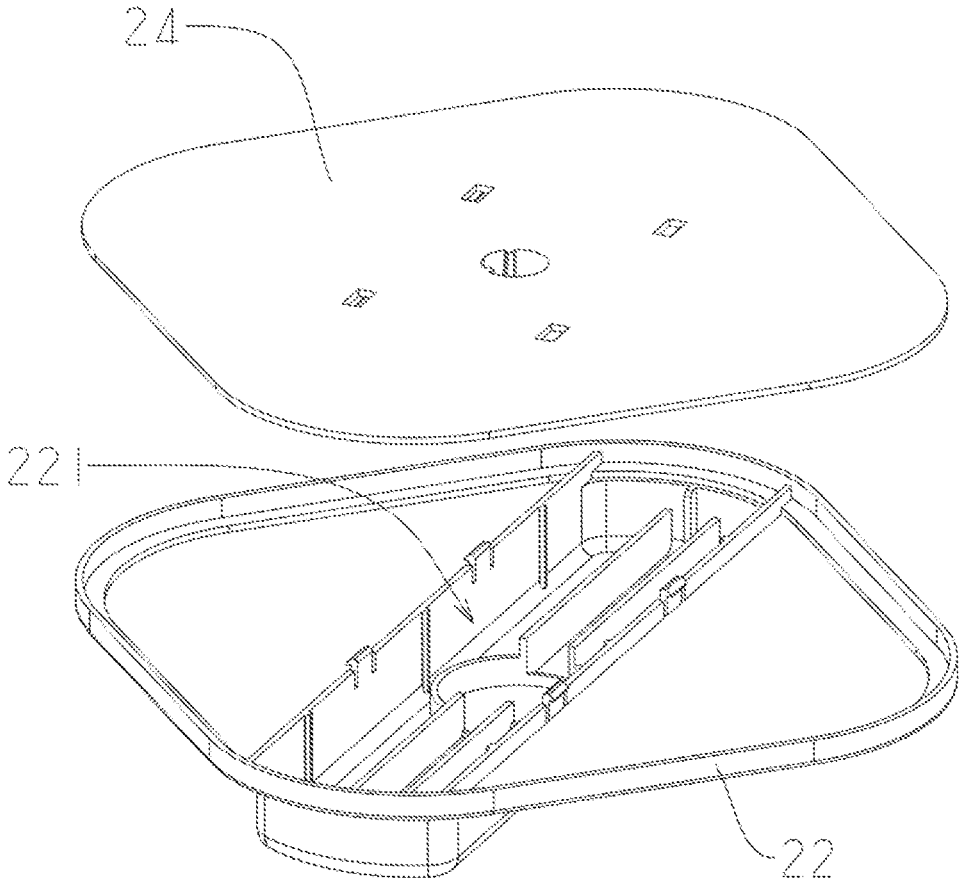
FIG. 5 is a view illustrating the structure of a lifting plate of embodiment one.
Figure 6:
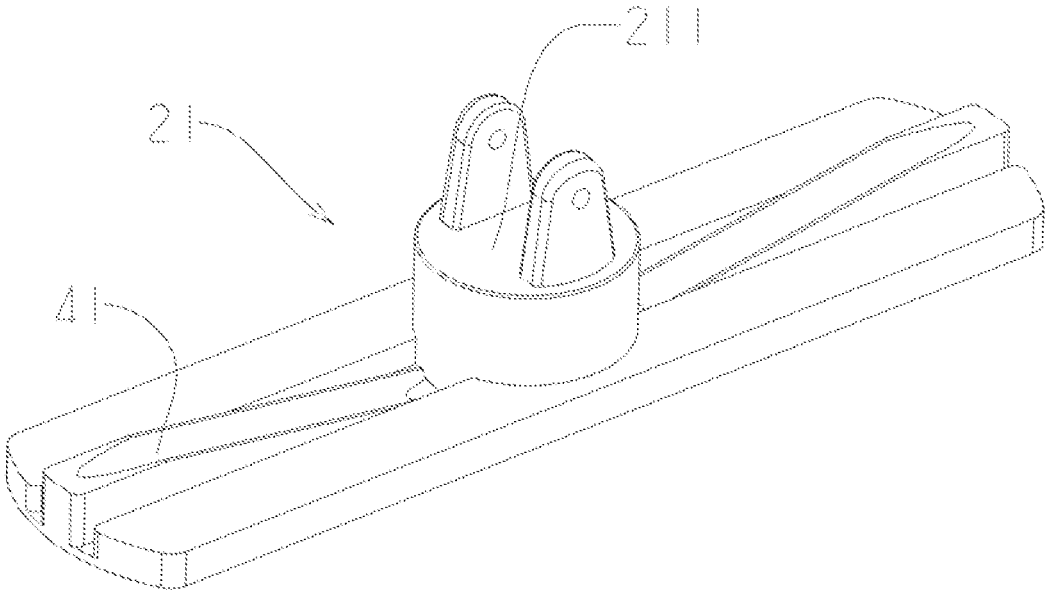
FIG. 6 is a view illustrating the structure of a fixed plate of embodiment one.

Specific structures of the fixed plate 21 and the lifting plate 22 are shown in FIGS. 5 and 6. The lifting plate 22 22 has a cavity 221, the fixed plate 21 is located within the cavity 221, the fixed plate 21 has a boss 211 protruding out of the cavity 221, and the mop rod 3 is movably connected to the boss 211.

In this embodiment, the mop rod 3 is connected to the boss 211 by a cross shaft so that the mop head 2 can rotate in a universal direction. The lifting plate 22 is further provided with a panel 24 for mounting the wipe, the panel 24 and the lifting plate 22 are detachably connected to each other.

Figure 7:
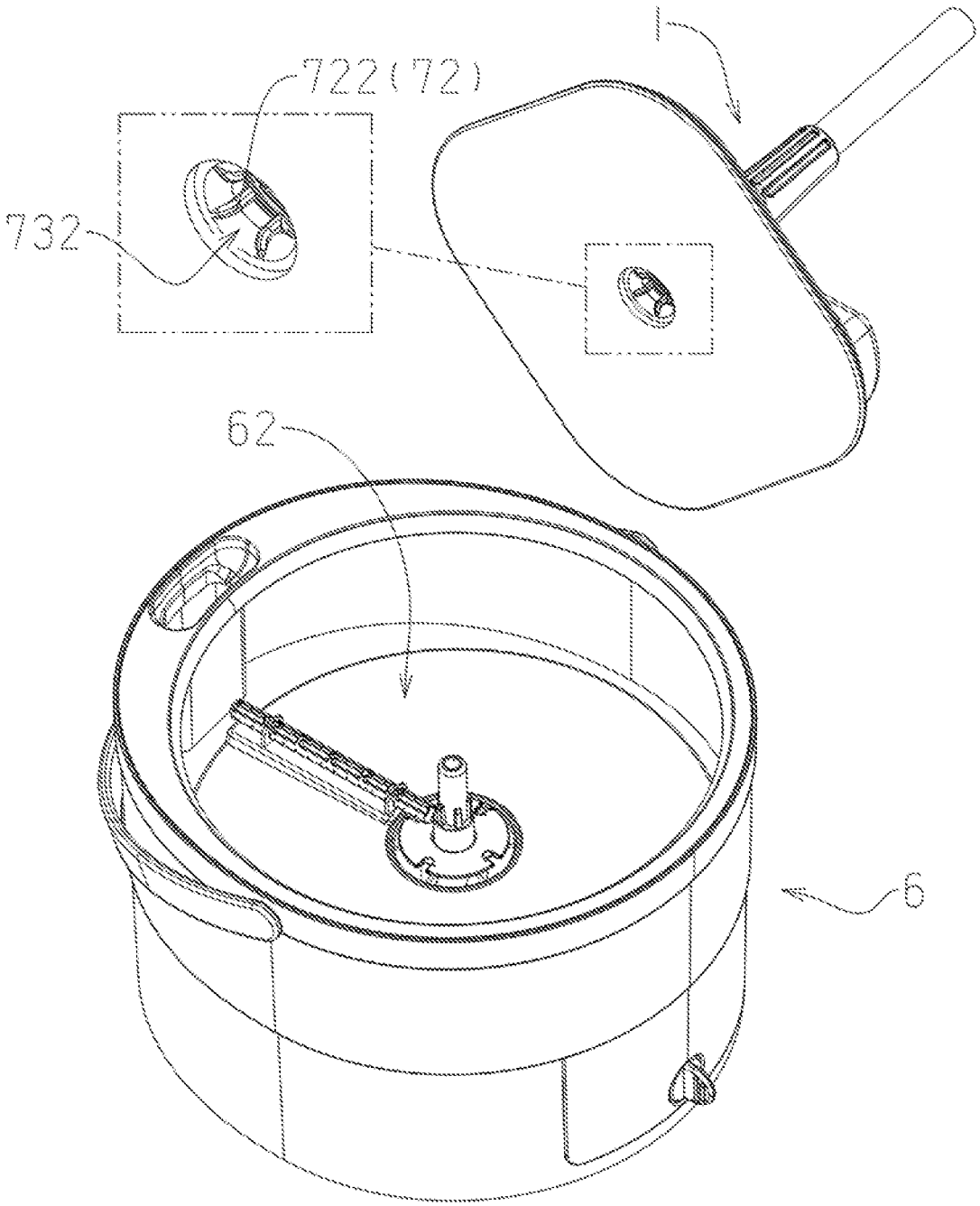
FIG. 7 is a view illustrating the overall structure of a cleaning tool of embodiment one.
Figure 8:
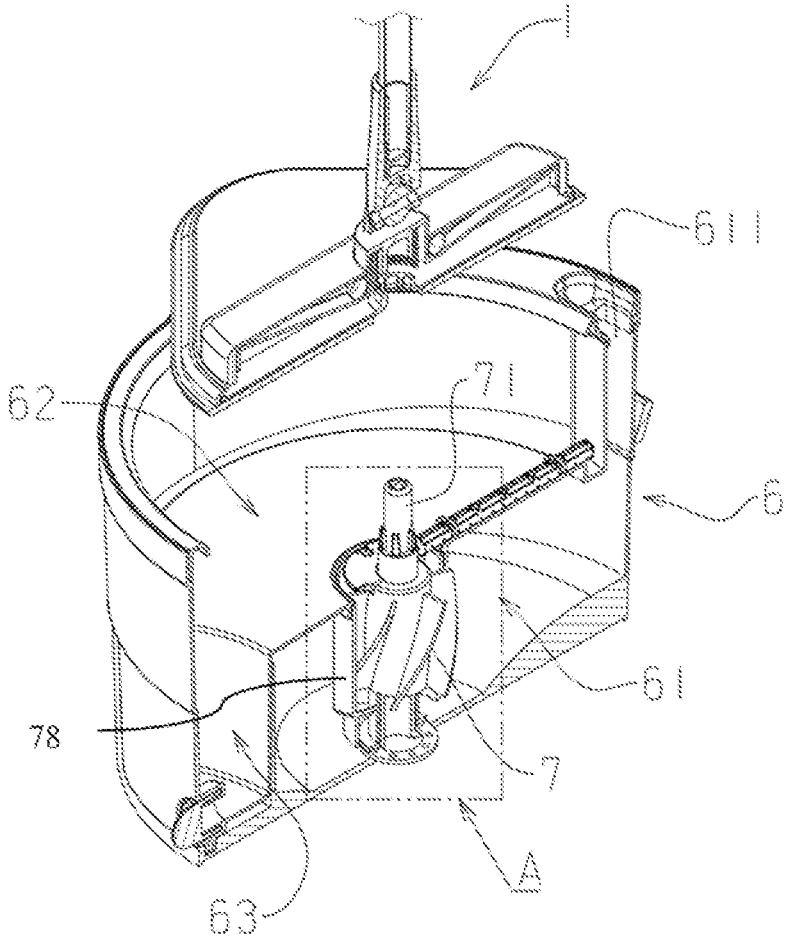
FIG. 8 is a sectional view of a cleaning tool of embodiment one.
Figure 9:
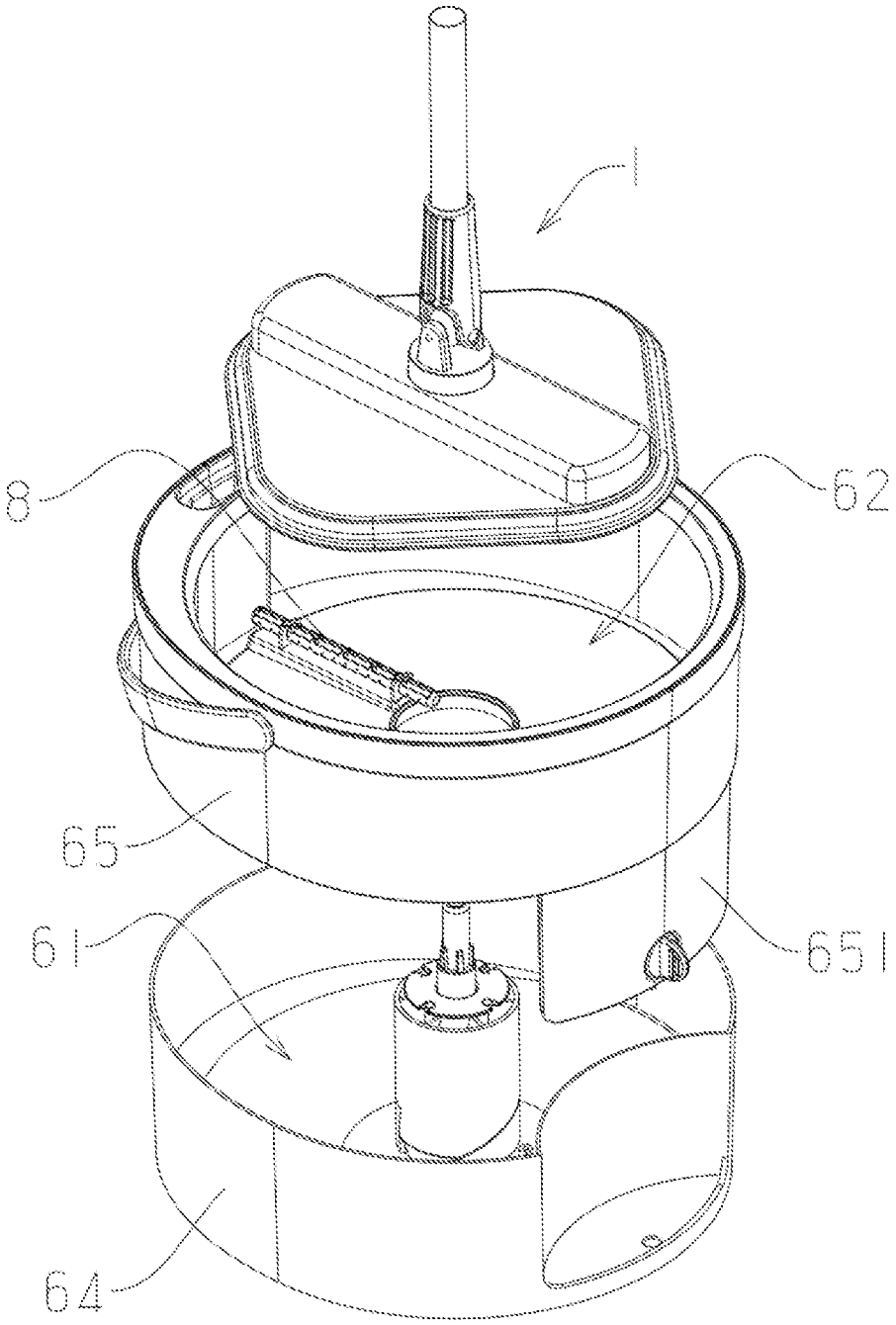
FIG. 9 is an exploded view illustrating the structure of a cleaning tool of embodiment one.

A cleaning tool is as shown in FIGS. 7 to 9. The cleaning tool includes a mop 1 and a mop bucket 6. The mop adopts the preceding rotary mop. The mop bucket 6 is provided with a clean water area 61 and a working area 62 above the clean water area 61. A pump 7 is located within the clean water area 61 and configured to pump clean water to the working area 62. A drive part 71 for driving the pump 7 to work penetrates from the clean water area 61 to the working area 62, and simultaneously, the drive part also forms a support part for supporting the working of the mop.

The penetrating drive part is also configured to form the support column 66 for supporting the working of the mop, the mop is supportable by the drive part to be capable of working rotatably, and an engaging part 72 is provided between the lifting plate 22 and the drive part so as to stop the lifting plate 22 and the drive part from rotating in a circumferential direction, when the lifting plate 22 is located at the low position, the engaging part is configured to engage to drive the pump 7 to work, and the pump 7 is configured to pump out the clean water and spray the clean water on the mop; and when the lifting plate 22 is located at the high position, the engaging part 72 is configured to disengage to cause the pump 7 to stop working and cause the mop to continue to rotate for dewatering.

The cleaning tool of the present disclosure does not need to be pulled manually at the time of switching between the cleaning operation and the dewatering operation, the operation of lifting and lowering the mop head 2 is completed by adjusting the rotational speed of the mop head 2 so as to achieve the seamless switching between cleaning and dewatering, and it also does not need to wait for the mop head 2 to stop rotating at the time of switching, saving time and labor. During cleaning, water is sprayed by the pump 7 to achieve good cleaning effect.

The mop bucket 6 of the present disclosure also has a function of separating the clean water and the dirty water. The mop bucket 6 is further provided with a dirty water area 63 which does not communicate with the clean water area 61 and communicates with the working area 62, and dirty water generated by the working of the mop in the working area can flow into the dirty water area 63.

In this embodiment, the mop bucket 6 includes a first bucket body 64 and a second bucket body 65 which are stacked in the upper and lower direction, the first bucket body 64 under the second bucket body 65 is the clean water area 61, the second bucket body 65 on the first bucket body 64 is the working area 62, and the clean water area 61 is also provided with a water injection port 611.

The periphery of the second bucket body 65 extends downward to form a receiving chamber 651. The receiving chamber 651 is the dirty water area 63, and the dirty water area 63 formed by the receiving chamber 651 extending downwardly is lower than the working area 62, thus the waste water generated in the working area 62 can automatically flow into the dirty water area 63 under an action of gravity.

Figure 10:
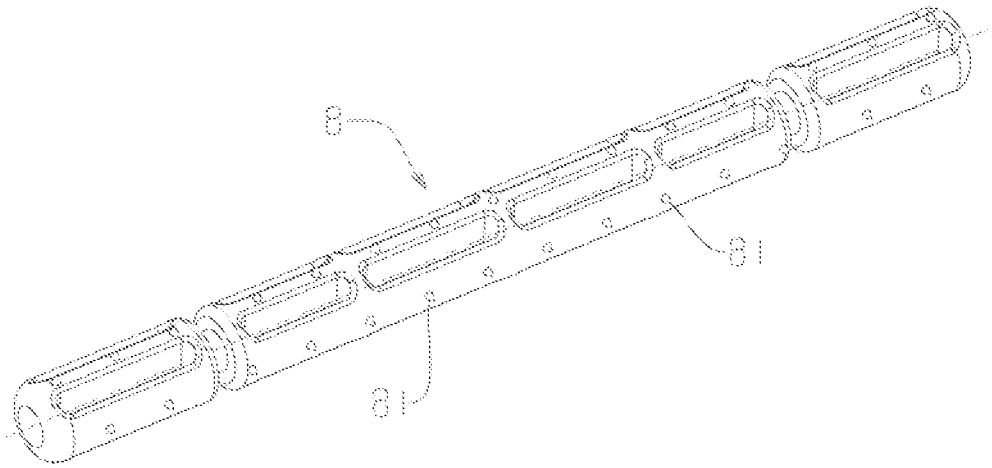
FIG. 10 is view illustrating the structure of a roller of embodiment one.

As shown in FIGS. 9 and 10, a cleaning member for cleaning the wipe of the mop is arranged within the mop bucket 6, and in this embodiment, the cleaning member is a roller 8 horizontally arranged, the roller 8 is rotatable along the axis of the roller 8 and several tines 81 are arranged on the periphery of the roller 8.

When the mop is operating in the working area 62, the roller 8 can form a certain squeeze with the wipe of the mop, and wastes on a surface of the wipe can be cleaned by the tines 81 on the surface thereof. The tines 81 in this embodiment are truncated cone shaped, and of course, the tines 81 may also be configured to be cone shaped or cylinder shaped.

Figure 11:
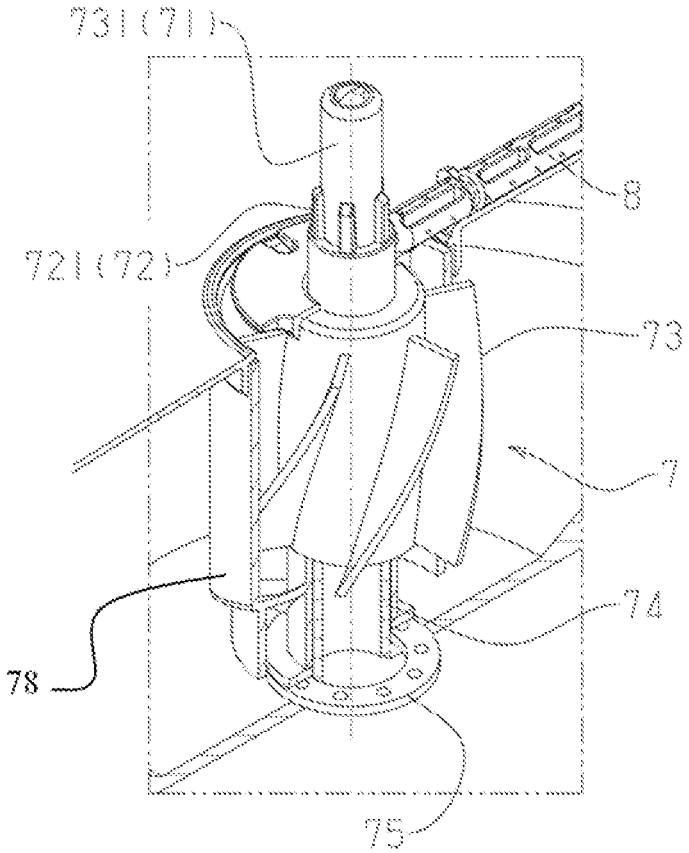
FIG. 11 is an enlarged view of a part A (a structure of a pump of embodiment one) of FIG. 8.

As shown in FIGS. 8 and 11, the pump includes a pump housing 78 and an impeller 73, the impeller 73 is sleeved on a spindle 74 fixed to the mop bucket 6 and is rotatable, the impeller 73 has a drive shaft 731 arranged coaxially with the impeller 73, the drive shaft 731 penetrates through the clean water area 61 and forms the drive part, and the mop head 2 has a positioning hole 732 available for the drive shaft 731 to insert.

In this embodiment, as shown in FIG. 11, the impeller 73 includes a first vane and a second vane. The second vane is located below the first vane and is arranged coaxially with the first vane, an upper end of the second vane extending upwardly until covering the first vane, a protruding part of the second vane forms the pump housing 78, and a water outlet speed of the second vane is smaller than a water outlet speed of the first vane.

Moreover, in this embodiment, the first blade and the second blade rotate synchronously and are both axial-flow blades, but have different blade angles. That is, different water outlet speeds are achieved through different blade angles. The blade angle refers to a water outlet angle of the blade, that is, an included angle between the blade and an end face of a wheel body. Different water outlet angles of the blades can provide different water pressures to achieve different water outlet speeds.

In this embodiment, the second blade is located below and is located at a water inlet 7741 communicating a clean water storage area and a pumping chamber for a first step of pumping. The second blade having a smaller blade angle pumps the clean water into the pumping chamber, and the first blade having a larger angle pumps the clean water out and sprays the clean water onto the mop. The first blade having the larger blade angle can provide a larger water pressure and flow velocity.

In addition, the pump housing 78 of the pump 7 may be configured as a conventional fixed structure, or a structure in which the pump housing 78 rotates in synchronization with the impeller 73 in this embodiment, and the pump housing 78 and the second blade are formed integrally in this embodiment.

More specifically, in the present disclosure, as shown in FIG. 3, the positioning hole 732 includes a blind hole 7321 located on the fixed plate 21 and a through hole 7322 located on the lifting plate 22. The blind hole 7321 and the through hole 7322 are arranged coaxially. When the mop is arranged at a shaft end of the drive shaft 731, the blind hole 7321 is used for supporting, and the lifting plate 22 having the through hole 7322 can be lifted or lowered freely without interference.

In this embodiment, as shown in FIGS. 7 and 11, the engaging part includes a rib 721 arranged on the periphery of the drive part and a groove 722 arranged on an inner side wall of the positioning hole 732, and the rib 721 and the groove 722 are capable of being engaged with each other to limit a circumferential rotation of the drive shaft 731 and the lifting plate 22.

The engaged structure of the rib 721 and the groove 722 is stable and can be molded for one time at the injection molding, which is easy to be manufactured.

The rotation axis of the impeller 73 in the present disclosure is arranged vertically, a plane bearing 75 is arranged between a lower end of the impeller 73 and the mop bucket 6. Since the drive shaft 731 protruding from the impeller 73 plays a role of supporting the mop head 2 simultaneously, especially when using a hand-pressed mop rod 3 in this embodiment, the impeller 73 is subjected to a large axial force and is liable to be worn when used for a long time. The plane bearing 75 is added, so that the rotation smoothness of the impeller 73 is improved and the service life of the impeller 73 is increased.

The working principle of the cleaning tool in this embodiment is as follows: the lifting plate 22 is located at a low position when the mop is in a normal state, the mop is arranged at the drive part to rotate for working, the engaging part is configured to engage to drive the pump 7 to pump out the clean water and spray the clean water on the mop to perform the clean operation of the mop. After cleaning for a certain time, a rotation speed of the mop head 2 is accelerated, and at a certain speed, the drive member 5 in the mop moves toward the periphery under the action of the centrifugal force, and the gap 4 arranged for reduction is opened so as to jack up the lifting plate 22 to the high position. In this case, the engaging part is configured to disengage to cause the pump 7 to stop working and cause the mop to continue to rotate for dewatering.

Embodiment Two

The difference between this embodiment and the embodiment one is a structure of a mop bucket 6.

Figure 12:
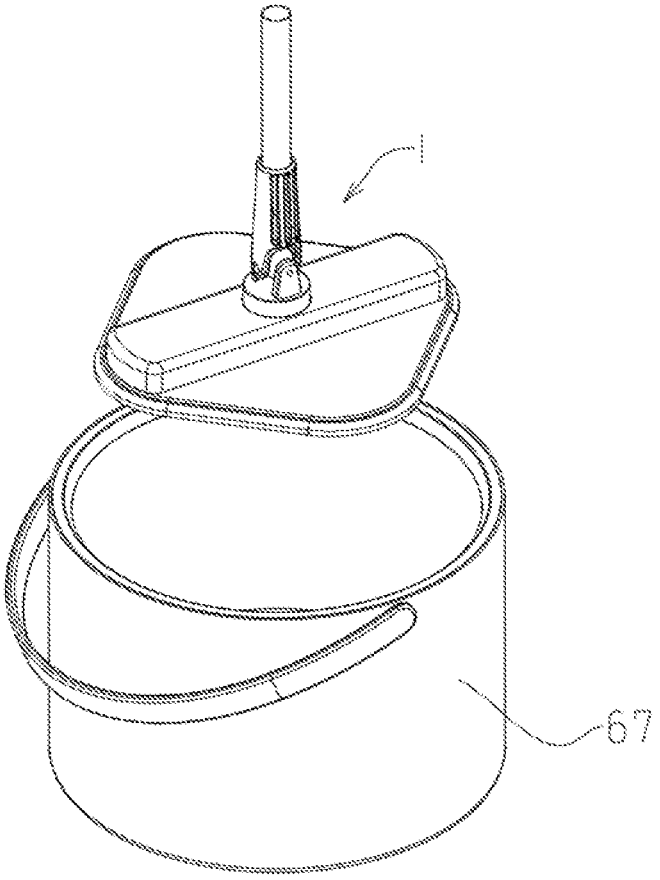
FIG. 12 is a view illustrating the overall structure of a cleaning tool of embodiment two.

In this embodiment, as shown in FIG. 12, the mop bucket 6 includes one bucket body, and a support column 66 is located in the mop bucket 6 and configured to support working of the mop. When the mop bucket 6 is used, an appropriate amount of water is placed in the mop bucket 6. When a lifting plate 22 of the mop is rotated at a low position, a wipe is in contact with the water surface, which is rotary cleaning in this case. After the lifting plate 22 is lifted by accelerating the rotation speed of the mop, the wipe leaves the water surface, which is rotary dewatering in this case.

Figure 13:
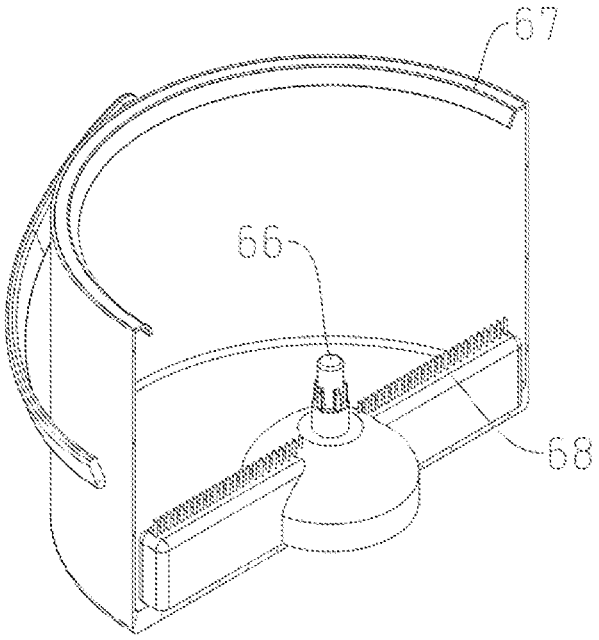
FIG. 13 is a sectional view of a mop bucket of embodiment two.
Figure 14:
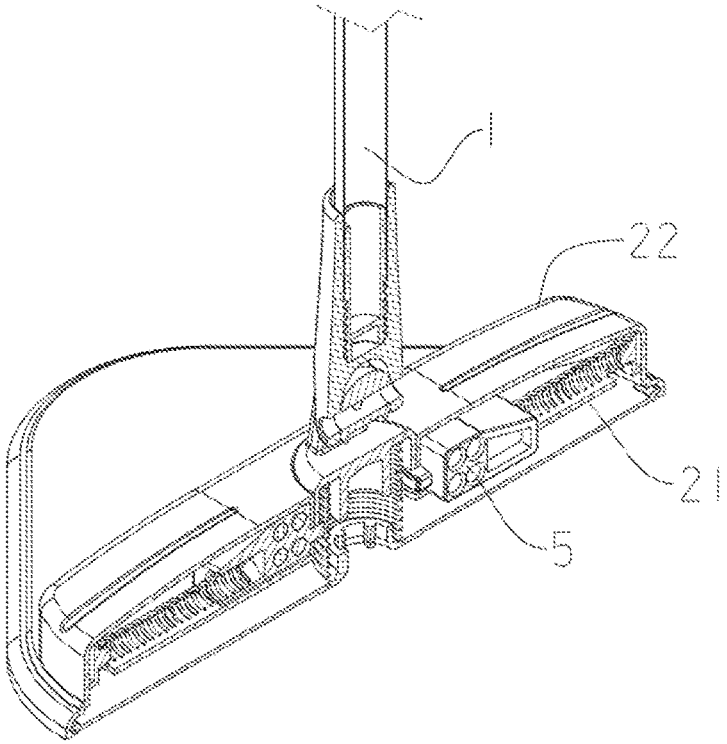
FIG. 14 is a view illustrating the overall structure of a rotary mop of embodiment three.
Figure 15:
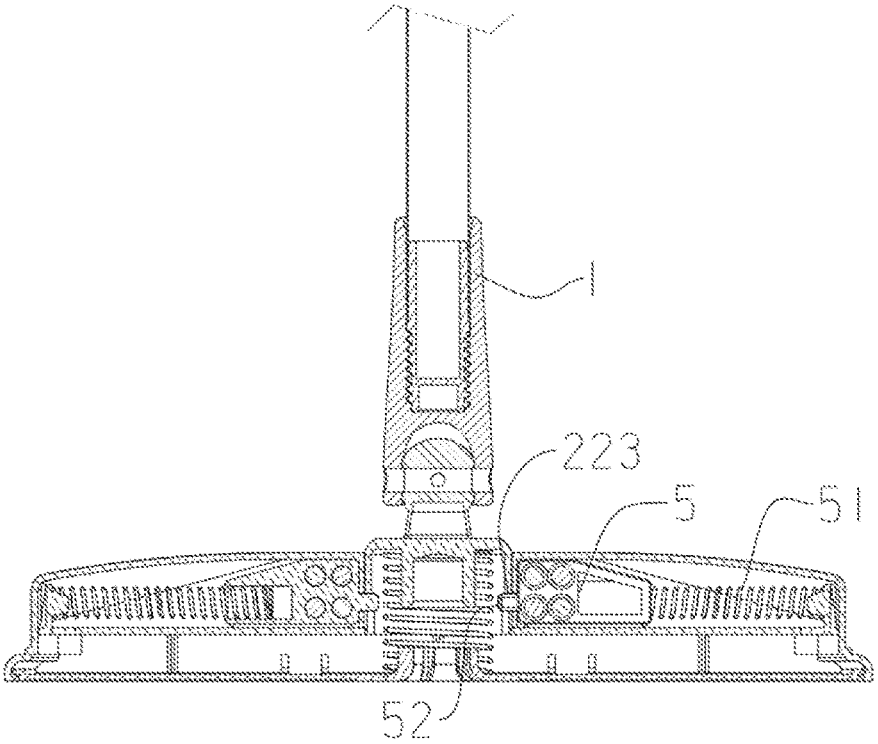
FIG. 15 is a sectional view of a rotary mop of embodiment three.
Figure 16:
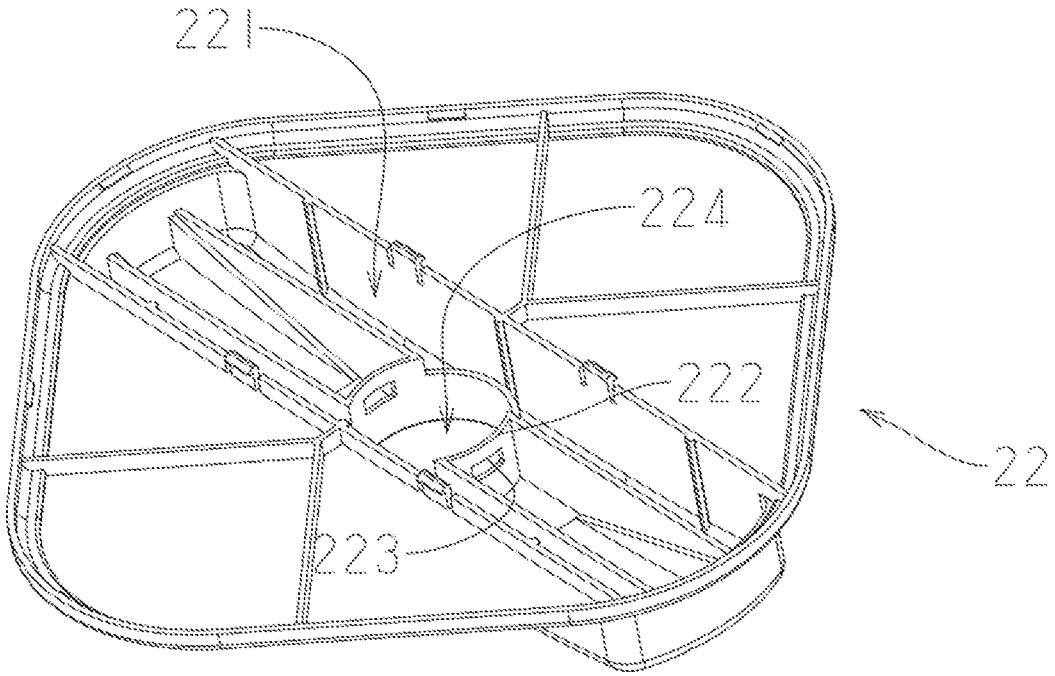
FIG. 16 is a view illustrating the structure of a lifting plate of embodiment three.

In this embodiment, as shown in FIG. 13, the bucket body 67 is further provided with a cleaning brush 68. When the mop cleans at the low position, the cleaning brush 68 brushes the wipe surface of the mop.

Embodiment Three

The difference between this embodiment and the embodiment one is a structure of a drive member 5 on a mop and a structure of a gap engaged with the drive member 5.

As shown in FIGS. 14 to 19, in this embodiment, the height gradient gap is achieved by being arranged on an inclined surface of the lifting plate 22, and the whole drive member 5 is a rectangular block, and the drive member 5 also has an inclined surface 54 matched with the inclined surface of the lifting plate 22.

The spherical drive member 5 moves mainly by rolling, which may also be accompanied by sliding. When the spherical structure is adopted, the lifting plate 22 has a high sensitivity, that is, the lifting plate 22 can move without a high rotation speed to achieve the drive lifting. The block-shaped drive member 5 is slidable, and the rotation speed required by the movement is relatively high due to the influence of the friction force. In fact, there is no judgement of good or bad between the spherical drive member Sand the block-shaped drive member 5, so that they can be used selectively for different mop heads (different weights brought by different mop head types).

In this embodiment, the through hole 224 for a boss passing through on the lifting plate 22 has an axially extended hole wall 222, the hole wall 222 abuts a sidewall of the boss, and both the hole wall 222 and the sidewall are provided with a through opening 223, the drive member 5 is provided with a positioning column 52 which is insertable into the through opening 223, and when the drive member 5 is located at the end with the larger space of the gap (that is, the lifting plate 22 is located at a low position), the positioning column 52 is configured to be inserted into both through openings 223 to lock the lifting plate 22.

Moreover, the drive member 5 is provided with an elastic drive member 51 for driving the mop to move toward the end with the larger space of the gap. When the mop mops the floor, the lifting action of the lifting plate 22 is inserted and locked by the positioning column 52, and the locking state is maintained by the abutment of the elastic drive member 51, so that the lifting plate 22 can be prevented from shaking due to the displacement of the drive member 5 when the mop mops the floor.

When the mop head 2 rotates, the elastic drive member 51 is able to impart a certain reverse pressure (damping) to the drive member 5, so that the movement of the drive member 5 under the action of the centrifugal force is more uniform, which can avoid the case where the drive member 5 moves to the bottom at once.

In this embodiment, the elastic drive member 51 is a helical compression spring.

Figure 18:
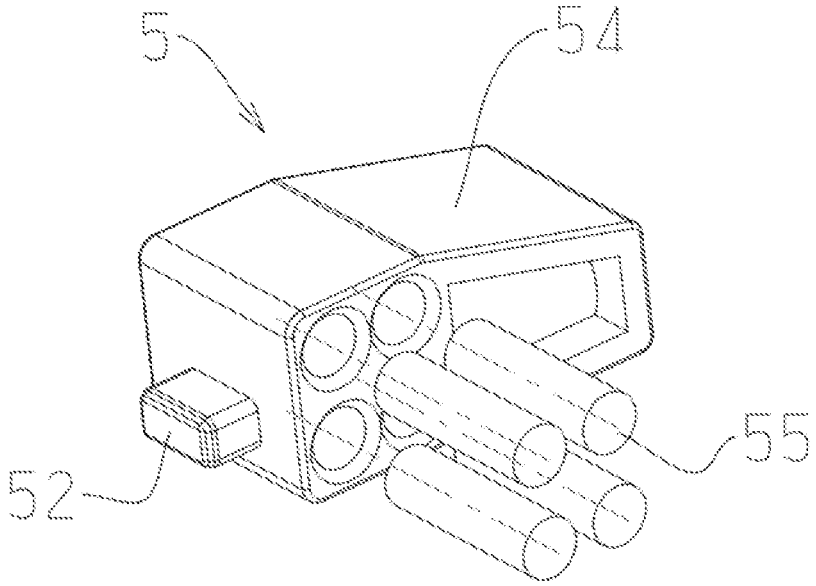
FIG. 18 is an exploded view of a drive member (a block drive member) of embodiment three.
Figure 19:
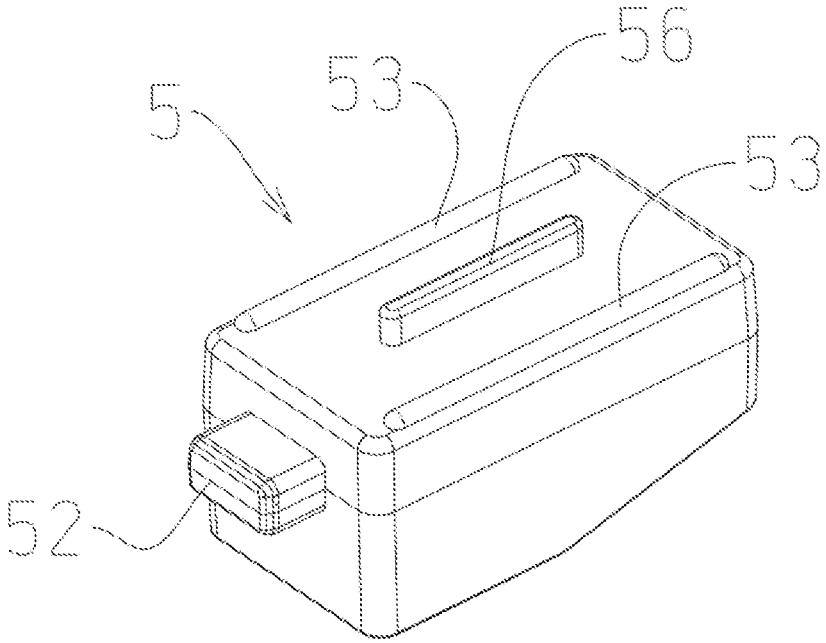
FIG. 19 is a view illustrating the structure of a drive member of embodiment three.

A structure of the drive member 5 is shown in FIGS. 18 and 19: a drive member body is a plastic member, and a metal weight 55 is embedded therein. A rib 53 is provided on a side of the drive member 5 being in contact with the fixed plate 21 to reduce the friction force when the drive member 5 moves. The process of making the plastic drive member into various shapes is mature and the cost is low. In this embodiment, the embedded weight (interference fit) is cylindrical and thus is relatively convenient to produce.

Figure 17:
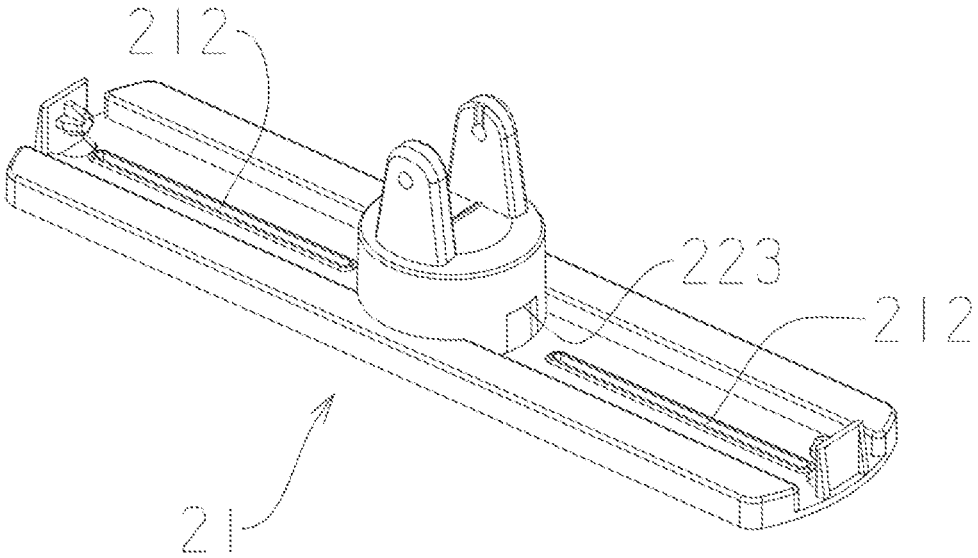
FIG. 17 is a view illustrating the structure of a fixed plate of embodiment three.

In addition, in this embodiment, as shown in FIGS. 17 and 19, a stopper structure is further provided on the side of the drive member 5 being in contact with the fixed plate 21, the stopper structure includes a stopper protrusion 56 arranged in the drive member 5 and a stopper groove 212 arranged in the fixed plate 21, the stopper protrusion can slide in the stopper groove, and sequentially restrict a movement trajectory of the drive member 5.

Embodiment Four

The difference between this embodiment and the embodiment one is a partial structure of a mop bucket 6 and a structure of a mop cooperatively used together.

Figure 20:
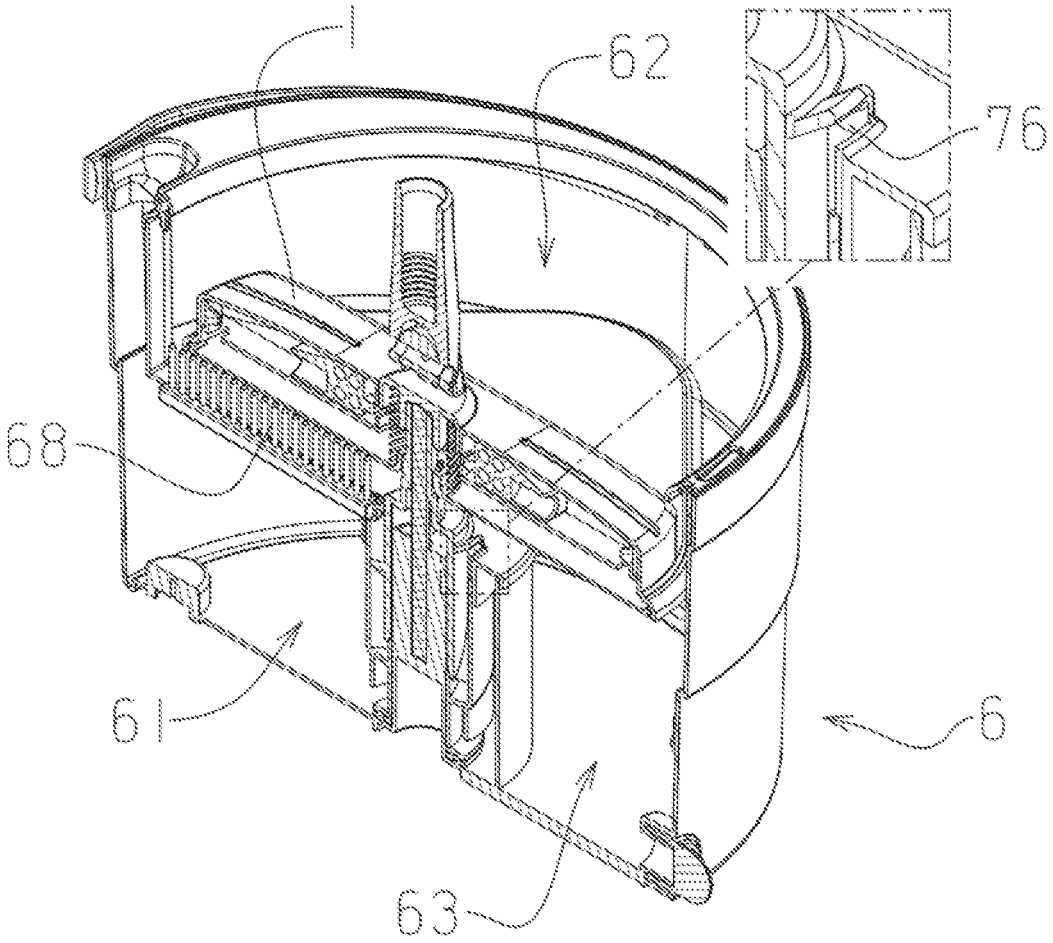
FIG. 20 is a sectional view of a cleaning tool of embodiment four.
Figure 21:
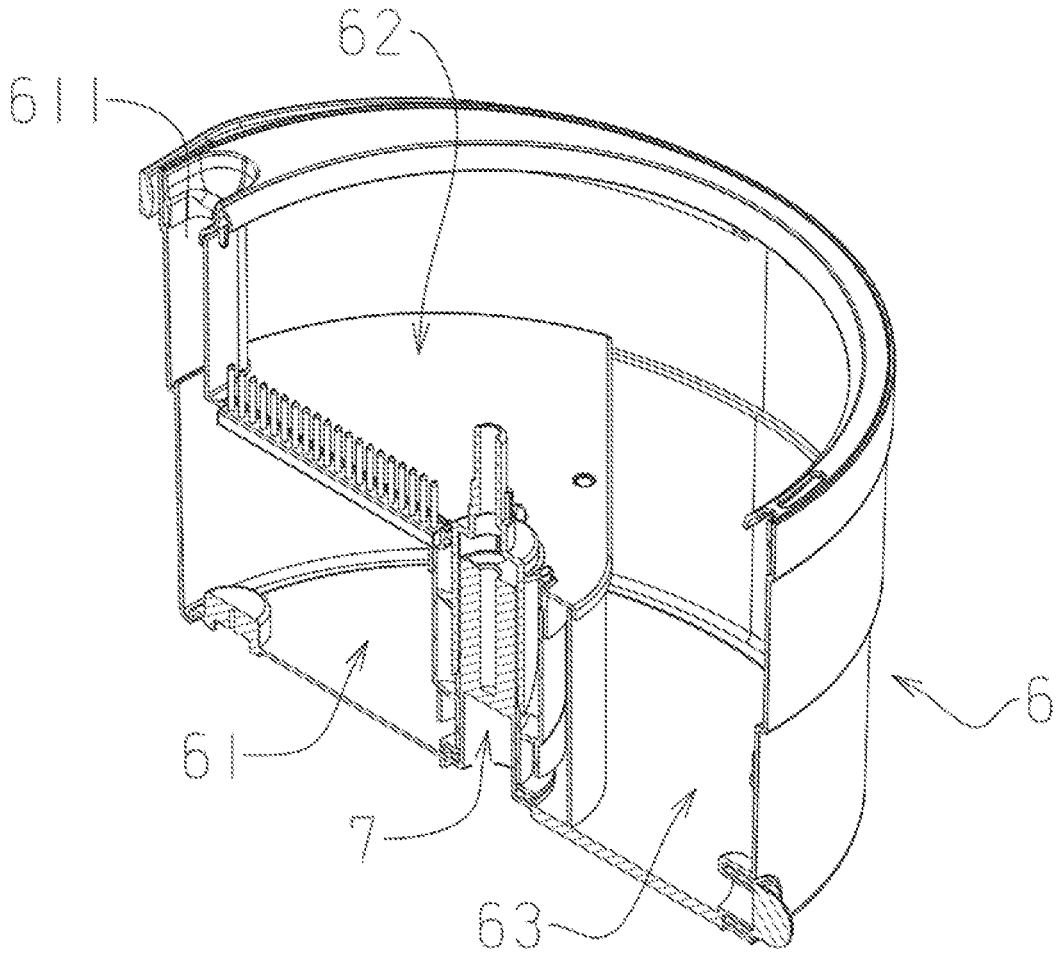
FIG. 21 is a sectional view of a mop bucket of embodiment four.
Figure 22:
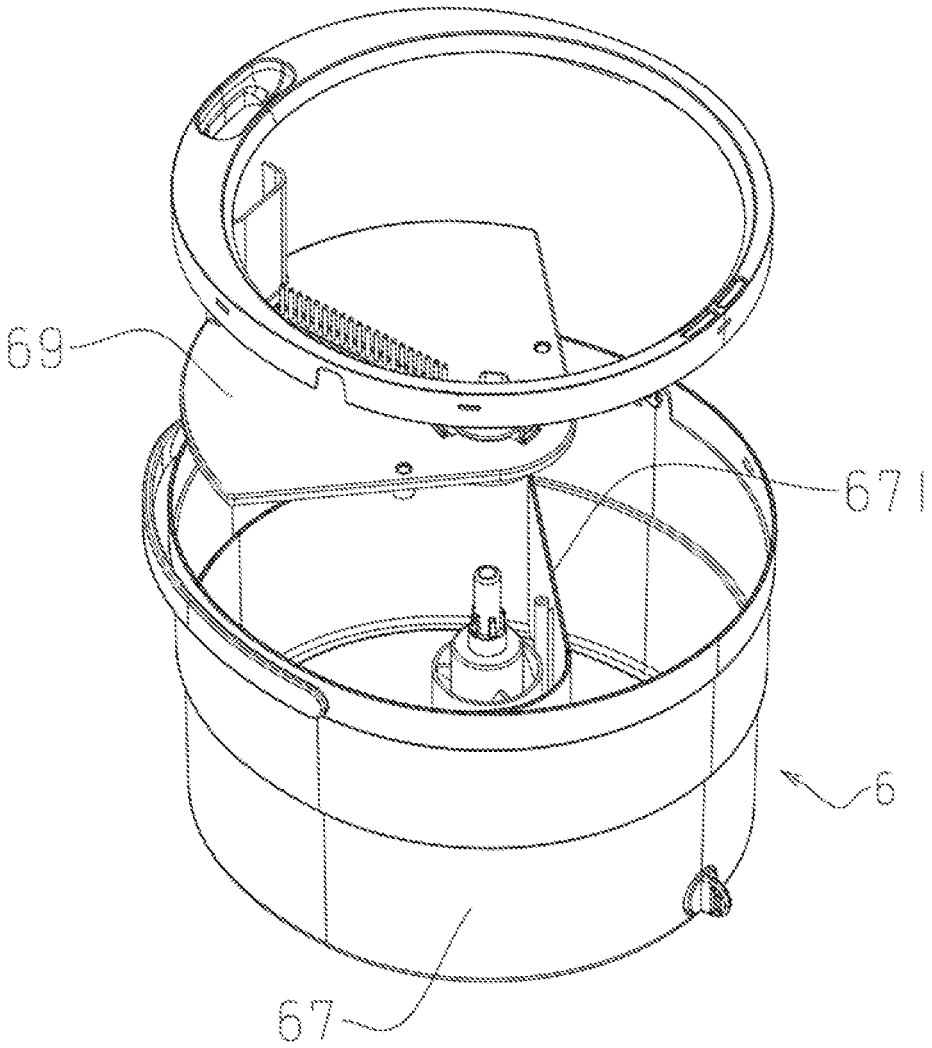
FIG. 22 is an exploded view of a mop bucket of embodiment four.

As shown in FIGS. 20 to 22, the mop bucket 6 includes one bucket body 67. The bucket body 67 has a partition plate 671 and a cover plate 69. The partition plate 671 separates an inner chamber of the bucket body 67 into a clean water area 61 and a dirty water area 63. The cover plate 69, which can be detachably connected is arranged above the clean water area 61. The working area 62 is above the cover plate 69. The cover plate 69 just covers the clean water area 61, so that the working area 62 can communicate with the dirty water area 63.

The mop used in this embodiment is the mop in the embodiment three, a cleaning member is a cleaning brush 68. The cleaning brush 68 is fixedly connected to a bottom of the working area 62.

The cleaning member in the present disclosure may employ various cleaning components known in the existing art, including a cleaning blade, a cleaning brush 68, a cleaning rod and the like. The cleaning blade is a plate-like or block-like protrusion.

In addition, a water outlet 76 (an opening for spraying water into the mop) of the pump in this embodiment is different from that in the embodiment one. The water outlet 76 in this embodiment is only a through opening. The water outlet 76 in this embodiment is provided with a guide structure for guiding the water. A direction of spraying water is adjusted by the guide structure, so that the mop can be sprayed (cleaned) better.

Embodiment Five

The difference between this embodiment and the embodiment one is a structure of a pump 7.

Figure 23:
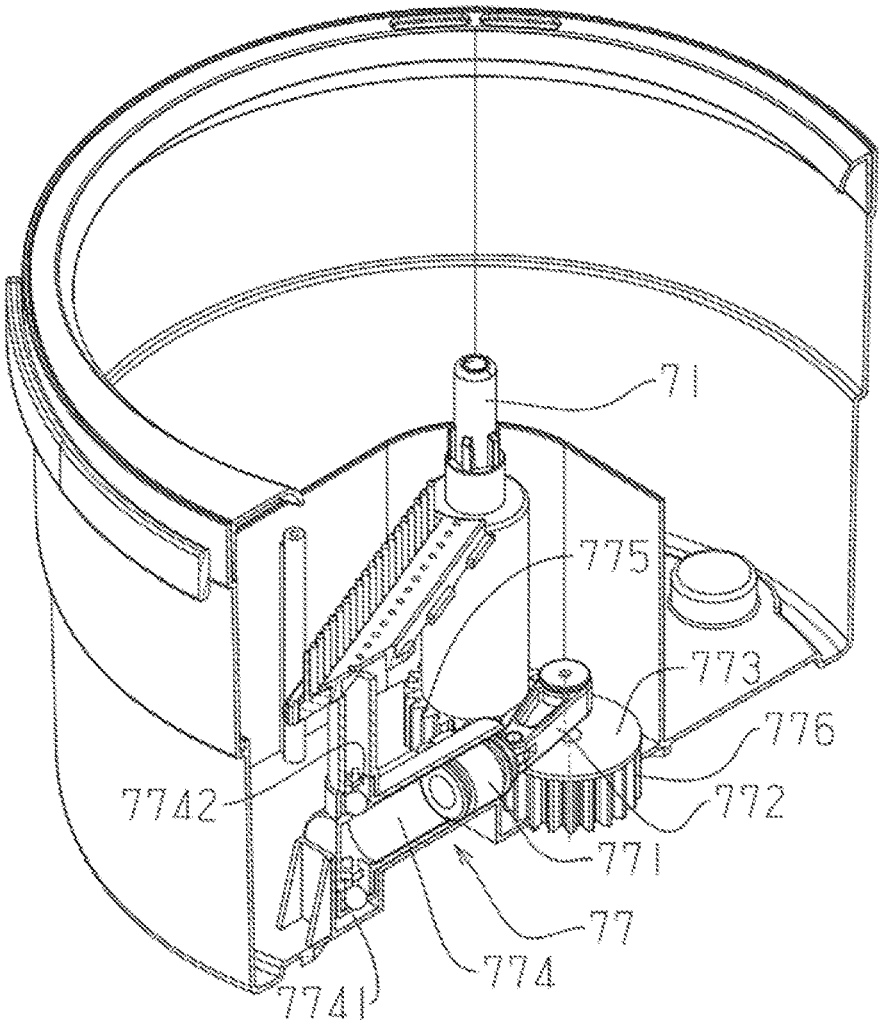
FIG. 23 is a sectional view of a mop bucket of embodiment five.

As shown in FIG. 23, the pump 7 includes a piston pump 77. The piston pump 77 is connected to a drive part 71 and is driven by the drive part 71.

In this embodiment, the piston pump 77 includes a pump body 774 and a piston rod 771, the piston rod 771 is located at one end of the hollow pump body 774, the other end of the pump body 774 is provided with a water inlet 7741 and a water outlet 7742, the water inlet 7741 is provided with a one-way valve which is restricted to be a water inlet only, and the water outlet 7742 is provided with a one-way valve which is restricted to be a water outlet only. When the piston rod pumps the water, the clean water enters the pump body 774 from the water inlet 7741. In this case, the water outlet 7742 is blocked by the. When the piston rod 771 pressurizes water, the water in the pump body 774 is discharged from the water outlet 77421. In this case, the water inlet 7741 is blocked by the one-way valve.

More specifically, both ends of a connecting rod 772 are hinged to the piston rod 771 and an eccentric wheel 773, and the eccentric wheel 773 is connected to the drive part 71 through a gear mechanism, so that the rotation movement is converted into the linear movement by the eccentric wheel 773 mechanism.

In this embodiment, both the support part and the drive part 71 both are rotatable support column, and the gear mechanism includes a driving gear 775 located at a lower end of the support column and a driven gear 776 arranged on the periphery of the eccentric wheel 773. The driving gear 775 and the support column are formed integrally, and the driven gear 776 and the eccentric wheel 773 are formed integrally.

Figure 24:
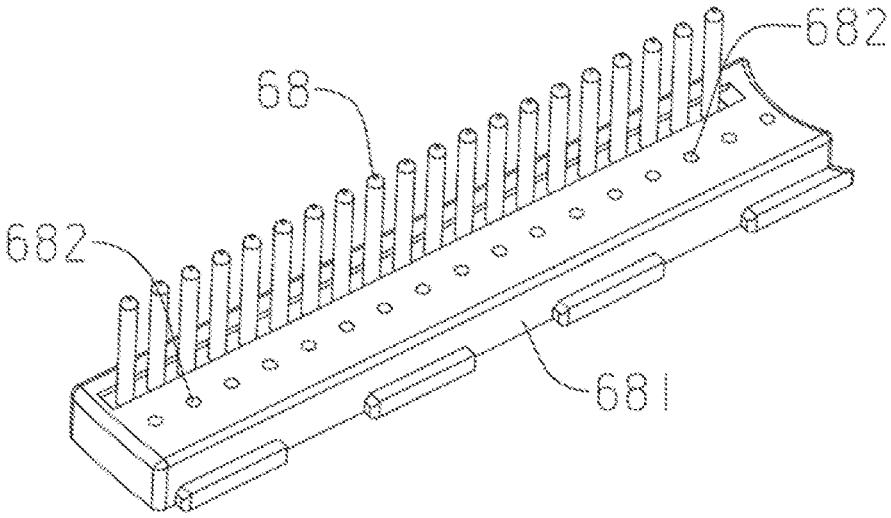
FIG. 24 is a view illustrating the structure of a swash holder and a cleaning member of embodiment five.

In this embodiment, as shown in FIG. 24, a working area 62 is further provided with a swash holder 681. A cleaning member is arranged on a swash holder 681, the swash holder 681 has multiple water spray ports 682, all water spray ports 682 are directly below a wipe of the mop, and a water outlet of the pump 7 communicates with the water spray ports 682 so that the water pumped by the pump 7 can be evenly sprayed on the mop.

A mop bucket in this embodiment is divided into areas (a clean water area 61, a working area 62, and the like). Alternatively, a single bucket without being divided into the areas may be provided, and the pump 7 is arranged in the single bucket to complete the water-spray cleaning operation.

The above are merely embodiments of the present disclosure and not intended to limit the scope of the present disclosure. Any equivalent structural variations made on the basis of the Description and the drawings of the present disclosure, or direct or indirect utilization in other relevant fields all fall within the scope of the present disclosure.

What is claimed is:

1. A mop self-lifting cleaning tool, comprising a mop and a mop bucket, wherein the mop comprises a mop head and a mop rod, and wherein a support column is located in the mop bucket and configured to support working of the mop, and the mop rod supports the mop head for cleaning and/or dewatering;

the mop head comprises a fixed plate and a lifting plate, the fixed plate is connected to the mop rod and is rotatable, and the lifting plate is configured to move up and down relative to the fixed plate and is rotatable along with the fixed plate; and a gap is provided between the lifting plate and the fixed plate, wherein the gap is increasingly smaller from a center of the lifting plate to a periphery of the lifting plate; a drive member is located in the gap; when the drive member is located at an end with a larger space of the gap, the lifting plate is located at a low position, and when the mop head rotates, the drive member is configured to move toward the periphery under an action of a centrifugal force and drive the gap to increase so as to elevate the lifting plate to a high position.

2. The mop self-lifting cleaning tool of claim 1, wherein a guide groove is located within the gap and configured to guide a movement direction of the drive member, the guide groove is opened at one of the lifting plate or the fixed plate, and the guide groove is oblique to form a structure in which the gap is increasingly smaller from the center of the lifting plate to the periphery of the lifting plate.

3. The mop self-lifting cleaning tool of claim 2, wherein the lifting plate has a cavity, the fixed plate is located within the cavity, the fixed plate has a boss protruding out of the cavity, the lifting plate has a through hole for the boss to penetrate through, and the mop rod is movably connected to the boss.

4. The mop self-lifting cleaning tool of claim 1, wherein the drive member is spherical or block-shaped, and the drive member is provided with an elastic drive member for driving the drive member to move toward the end with the larger space of the gap.

5. The mop self-lifting cleaning tool of claim 4, wherein the lifting plate has a cavity, the fixed plate is located within the cavity, the fixed plate has a boss protruding out of the cavity, the lifting plate has a through hole for the boss to penetrate through, and the mop rod is movably connected to the boss.

6. The mop self-lifting cleaning tool of claim 1, wherein an elastic member is provided between the fixed plate and the lifting plate, and the elastic member is configured to keep the gap small to make the lifting plate at the low position.

7. The mop self-lifting cleaning tool of claim 6, wherein the lifting plate has a cavity, the fixed plate is located within the cavity, the fixed plate has a boss protruding out of the cavity, the lifting plate has a through hole for the boss to penetrate through, and the mop rod is movably connected to the boss.

8. The mop self-lifting cleaning tool of claim 1, wherein the mop rod is a hand-pressed rotary mop rod, and the fixed plate is configured to be driven to rotate through the hand-pressed rotary mop rod; or the mop head is configured to be driven to rotate through a motor.

9. The mop self-lifting cleaning tool of claim 1, wherein the lifting plate has a cavity, the fixed plate is located within the cavity, the fixed plate has a boss protruding out of the cavity, the lifting plate has a through hole for the boss to penetrate through, and the mop rod is movably connected to the boss.

10. The mop self-lifting cleaning tool of claim 9, wherein the through hole has an axially extended hole wall, the hole wall abuts a sidewall of the boss, both the hole wall and the sidewall are provided with a through opening, the drive member is provided with a positioning column which is insertable into the through opening; and when the drive member is located at the end with the larger space of the gap, the positioning column is configured to be inserted into the through opening to lock the lifting plate.

11. The mop self-lifting cleaning tool of claim 1, wherein the mop bucket is provided with a clean water area and a working area above the clean water area, a pump is located within the clean water area and configured to pump clean water to the working area, a drive part for driving the pump to work penetrates from the clean water area to the working area, and an upper end of the drive part is the support column; and the mop is supportable by the drive part to be capable of working rotatably; an engaging part is provided between the lifting plate and the drive part so as to stop the lifting plate and the drive part from rotating in a circumferential direction;

when the lifting plate is located at the low position, the engaging part is configured to engage to drive the pump to work, and the pump is configured to pump out the clean water and spray the clean water on the mop; and when the lifting plate is located at the high position, the engaging part is configured to disengage to cause the pump to stop working and cause the mop to continue to rotate for dewatering.

12. The mop self-lifting cleaning tool of claim 11, wherein the mop bucket is further provided with a dirty water area which does not communicate with the clean water area and communicates with the working area, and the dirty water area is configured such that dirty water generated by the working of the mop in the working area is capable of flowing into the dirty water area.

13. The mop self-lifting cleaning tool of claim 12, wherein the mop bucket comprises a first bucket body and a second bucket body which are stacked in an upper and lower direction, the first bucket body under the second bucket body is the clean water area, the second bucket body on the first bucket body is the working area, and a periphery of the second bucket body extends downward to form a receiving chamber, and the receiving chamber is the dirty water area.

14. The mop self-lifting cleaning tool of claim 12, wherein the mop bucket comprises a bucket body, and the bucket body has a partition plate and a cover plate, wherein the partition plate separates an inner chamber of the bucket body into the clean water area and the dirty water area, the cover plate is arranged above the clean water area, and the working area is above the cover plate.

15. The mop self-lifting cleaning tool of claim 11, wherein the pump comprises a pump housing and an impeller, the impeller is sleeved on a spindle fixed to the mop bucket and is rotatable, the impeller has a drive shaft arranged coaxially with the impeller, the drive shaft penetrates through the clean water area and forms the drive part, and the mop head has a positioning hole available for the drive shaft to insert.

16. The mop self-lifting cleaning tool of claim 11, wherein the pump comprises a piston pump, and the piston pump is connected to the drive part and is driven by the drive part.

17. The mop self-lifting cleaning tool of claim 16, wherein a piston rod of the piston pump is hinged to an eccentric wheel through a connecting rod, and the eccentric wheel is connected to the drive part through a gear mechanism.

18. The mop self-lifting cleaning tool of claim 11, wherein the engaging part comprises a ridge arranged on a periphery of the drive part and a groove arranged on an inner side wall of the positioning hole, and the ridge and the groove are capable of being engaged with each other to limit a circumferential rotation of the drive shaft and the lifting plate.

19. The mop self-lifting cleaning tool of claim 1, wherein a cleaning member for cleaning the mop is arranged in the mop bucket, and when cleaning the mop at the low position, the cleaning member is in contact with a wipe of the mop for cleaning the wipe.

20. The mop self-lifting cleaning tool of claim 19, wherein the cleaning member comprises a cleaning blade, a cleaning brush, or a roller rotatable along an axis of the roller.

* * * * *